US011078741B2

(12) United States Patent
Mattey et al.

(10) Patent No.: US 11,078,741 B2
(45) Date of Patent: Aug. 3, 2021

(54) ALIGNMENT MECHANISM

(71) Applicant: OneSubsea IP UK Limited, London (GB)

(72) Inventors: Alexander Mattey, Houston, TX (US); Paul Osborne, Leeds (GB); John Maher, Weybridge (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 16/386,305

(22) Filed: Apr. 17, 2019

(65) Prior Publication Data

US 2019/0316436 A1 Oct. 17, 2019

Related U.S. Application Data

(60) Provisional application No. 62/658,873, filed on Apr. 17, 2018.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | | |
|---|---|---|---|---|
| 3,661,206 | A | 5/1972 | Putch | |
| 4,386,656 | A | 6/1983 | Fisher et al. | |
| 4,721,163 | A | 1/1988 | Davis | |
| 6,019,175 | A * | 2/2000 | Haynes | E21B 33/04 166/334.1 |
| 6,360,822 | B1 | 3/2002 | Robertson | |
| 6,378,613 | B1 | 4/2002 | Kent et al. | |
| 7,770,650 | B2 | 8/2010 | Young et al. | |
| 8,151,892 | B2 | 4/2012 | Williams et al. | |
| 8,720,578 | B2 | 5/2014 | Allensworth et al. | |
| 9,670,733 | B1 | 6/2017 | Ng | |
| 2003/0121667 | A1 | 7/2003 | Massie et al. | |
| 2004/0079529 | A1 | 4/2004 | Bartlett | |
| 2004/0238178 | A1 | 12/2004 | Laureano et al. | |

FOREIGN PATENT DOCUMENTS

WO 2014031463 A1 2/2014

OTHER PUBLICATIONS

Extended European Search Report issued in European Patent Appl. No. 19169806.7 dated Sep. 10, 2019; 7 pages.

* cited by examiner

*Primary Examiner* — Cathleen R Hutchins
(74) *Attorney, Agent, or Firm* — Eileen Pape

(57) ABSTRACT

A method includes landing a conductor housing on a wellbay. The method also includes engaging a first alignment feature on the wellbay with an orientation feature on the conductor housing. The method also includes engaging an alignment pin on the conductor housing with a wellhead housing. The wellhead housing includes a second alignment feature. The method further includes landing a tubing hanger alignment gasket using the second alignment feature of the wellhead housing. The tubing hanger alignment gasket provides orientation for a tubing hanger as the tubing hanger is landed through a blow-out preventer.

19 Claims, 18 Drawing Sheets

ALIGNMENT MECHANISM

CROSS-REFERENCE TO RELATED APPLICATION

The present document is based on and claims priority to U.S. Provisional Application Ser. No. 62/658,873, filed Apr. 17, 2018, which is incorporated herein by reference in its entirety.

BACKGROUND

During the installation of a tubing hanger (TH), a blow-out preventer (BOP) is installed on top of the wellhead system, and alignment of the tubing hanger is oftentimes performed through a tubing hanger orientation joint (THOJ) on a landing string and a BOP orientation pin mounted on the BOP. The BOP takes its rough alignment via the receiving structure. Fine alignment of the BOP is achieved by adding additional hardware to the structure and making modifications to the BOP to mount a corresponding interface, prior to running subsea. With the BOP removed, initial alignment of a vertical Christmas tree (VXT) is achieved using the same rough alignment mechanism as the BOP but fine alignment then takes over when the VXT interfaces with the tubing hanger. On the rig floor, the BOP is modified to install the guidance pin, oftentimes called a BOP orientation pin, which is set up using a jig to set the orientation system. Template systems and horizontal connection systems involve tight tolerances for successful operation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter According to an embodiment, a method comprises landing a conductor housing on a wellbay. The method also may include engaging a first alignment feature on the wellbay with an orientation feature on the conductor housing. The method may further include engaging an alignment pin on the conductor housing with a wellhead housing. In this example, the wellhead housing includes a second alignment feature. The method also may include landing a tubing hanger alignment gasket using the second alignment feature of the wellhead housing. The tubing hanger alignment gasket provides orientation for a tubing hanger as the tubing hanger is landed through a blow-out preventer.

According to another embodiment, a system comprises a wellbay including a first alignment feature. The system also may include a conductor housing having an orientation feature and an alignment pin. The first alignment feature may be configured to engage the orientation feature. The system may further include a wellhead housing configured to receive the alignment pin. According to an example, the wellhead housing includes a second alignment feature. The system also may include a tubing hanger alignment gasket configured to be landed using the second alignment feature of the wellhead housing. The tubing hanger alignment gasket provides orientation for a tubing hanger as the tubing hanger is landed, e.g. landed through a blow-out preventer.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
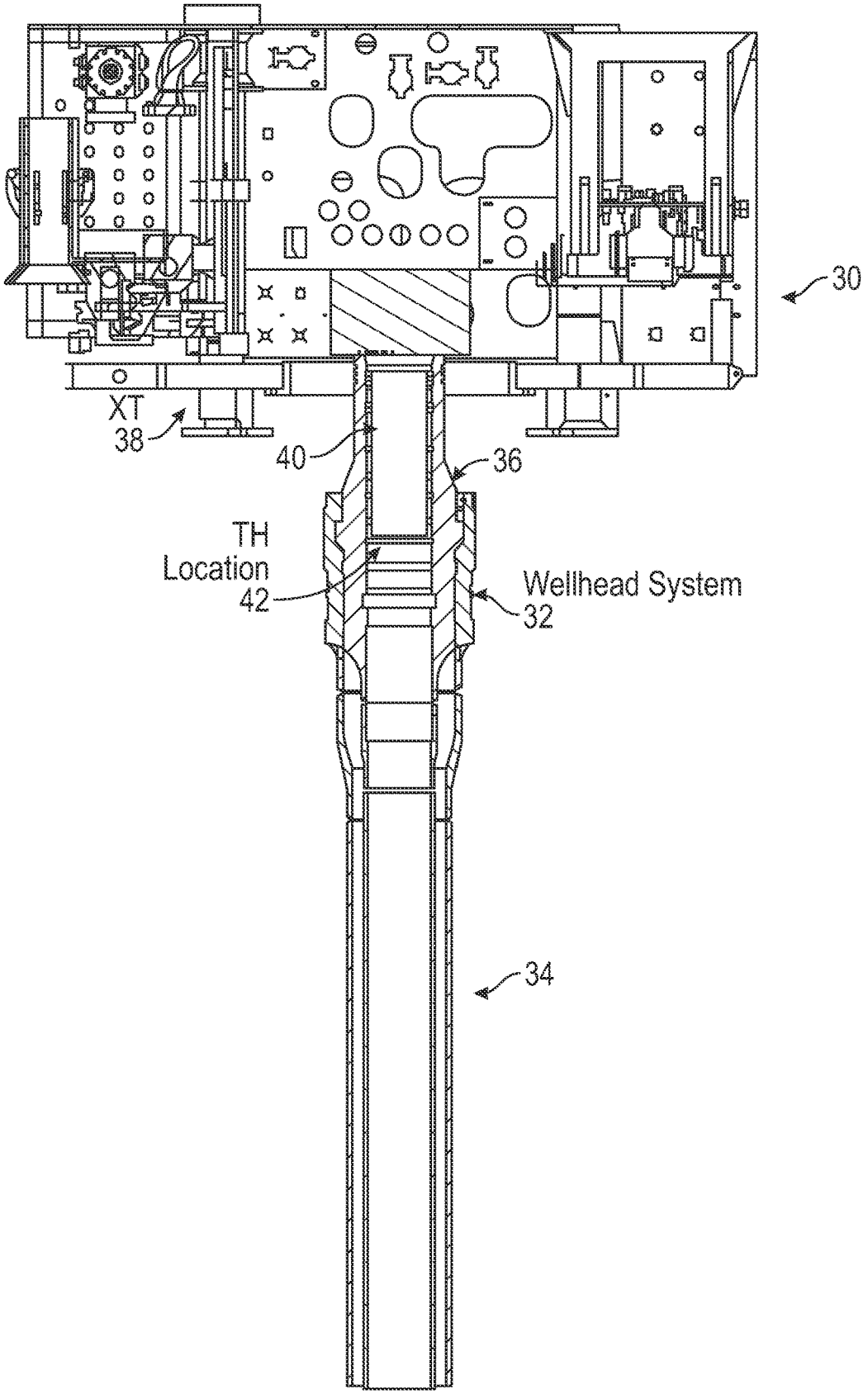
FIG. 1 shows a cross-sectional side view of a satellite well installation, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

The self-aligned wellhead system (SAWS) disclosed herein along with the tubing hanger alignment gasket (THAG) may provide for the installation of a tubing hanger inside a wellhead housing that can provide orientation to a Christmas tree (XT), e.g. a vertical Christmas tree (VXT). This installation alignment can be done in the form of a key/feature inside the wellhead or other components.

The self-aligned wellhead system (SAWS) is a stackable/self-guided wellhead system that allows for the use of a tubing hanger alignment gasket (THAG) or a keyway inside the wellhead housing to orientate the tubing hanger (TH) in a desired direction to ensure accurate/final orientation for the VXT. During the installation of the TH, a blow-out preventer (BOP) is installed on top of the wellhead system or on top of a guidance structure usually known as a spool body or tubing hanger orientation spool. At the rig floor, the BOP is modified to install a guidance pin, called a BOP alignment pin. A tubing hanger orientation joint (THOJ) may be used to test the TH installation to ensure it can be oriented properly. For a given well installation, e.g. an ITS well installation, these guidance structures, in some cases the BOP itself, obtain alignment with some sort of yolk, pin, or funnel built within the ITS such that the TH can be oriented in the direction that the VXT will be finally set. For a satellite well installation, a lesser degree of guidance may be used. However, the TH may be roughly set in the direction the VXT and finally oriented to ensure the flowline connection between the VXT and the manifold is accessible.

FIG. 1 shows a cross-sectional side view of a well installation 30 which in this embodiment is a satellite well installation. The well installation 30 may comprise a wellhead system 32 mounted above a well 34. The wellhead system 32 may comprise a wellhead 36 and types of equipment, such as a Christmas tree 38, e.g. a VXT, may be mounted to and above the wellhead 36. A tubing hanger (TH) 40 may be positioned within wellhead 36 at a tubing hanger location 42. In this embodiment, the wellhead system may be a self-aligned wellhead system and the tubing hanger 40 may be appropriately aligned via features which may include a tubing hanger alignment gasket as described in greater detail below.

Figure 2:
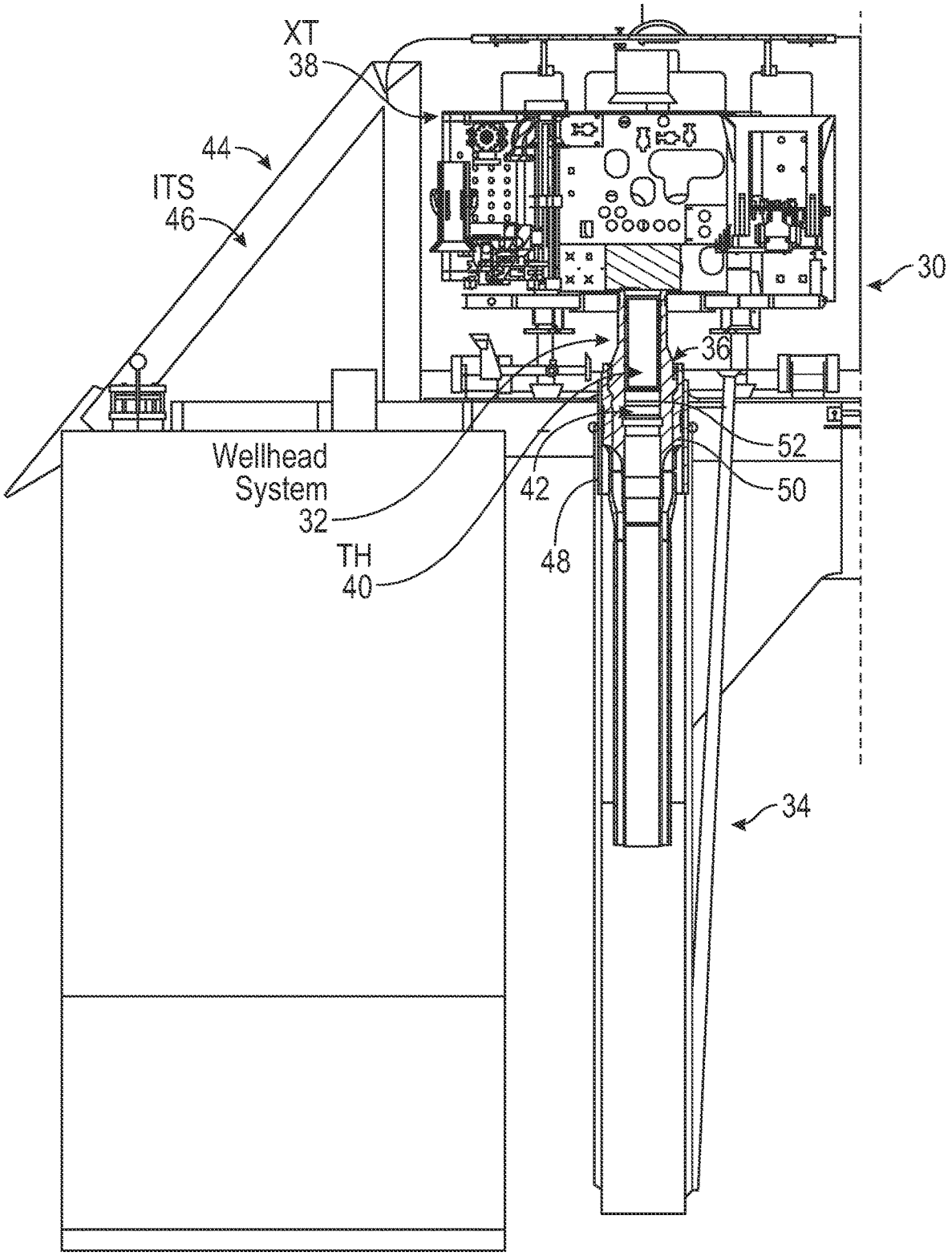
FIG. 2 shows a cross-sectional side view of an integrated template structure (ITS) well installation, according to an embodiment.

FIG. 2 shows a cross-sectional side view of another embodiment of well installation 30 which is in the form of an ITS well installation 44. This embodiment may include components similar to those described with respect to FIG. 1. As illustrated, however, this embodiment of well installation 30 comprises an integrated template structure (ITS) 46.

As described in greater detail below, the wellhead system 32 may be in the form of a self-aligned wellhead system (SAWS) which utilizes the actual wellhead system 32 to provide alignment to the TH 40 and eliminates the use of complex structures and/or BOP modifications which would otherwise conventionally be used to land the TH and VXT. In an ITS well installation 44, for example, a wellbay 48, where a conductor housing (CH) 50 is landed, may have a CH alignment system 49 such as an alignment feature that interfaces with an orientation feature on the CH 50 external diameter or vice-versa. Next, the CH 50 may also have an alignment system 51 such as a pin on its internal diameter that interfaces with a wellhead housing (WH) 52 of the wellhead system 32. For example, the CH 50 may have the alignment pin on its internal diameter that interfaces with the WH 52 external diameter or vice-versa. As described in greater detail below, the WH 52 also may contain an alignment feature (e.g., key way) 54 on its internal diameter located at the hub face gasket profile or below the tubing hanger lockdown grooves (e.g., in case of a different design). This feature 54 in the WH 52 allows for the use of a THAG 56 (see FIG. 3) to be landed, and the THAG 56 provides orientation for the TH 40 as it is landed through, for example, a BOP. For example, the THAG 56 may include a guidance feature 58 used to orient the TH 40 during installation. Additionally, the alignment feature 54 inside the wellhead housing 52 can be used for another sleeve/piece of equipment to be installed and provides alignment for the tubing hanger 40. The alignment pin/feature in the ITS wellbay, CH, and WH may be in the same vertical plane and allow for a large capture angle during installation. The weight of the CH 50 and WH 52 casing strings facilitates the twist to ensure engagement with the alignment pin/features mentioned before.

Figure 3:
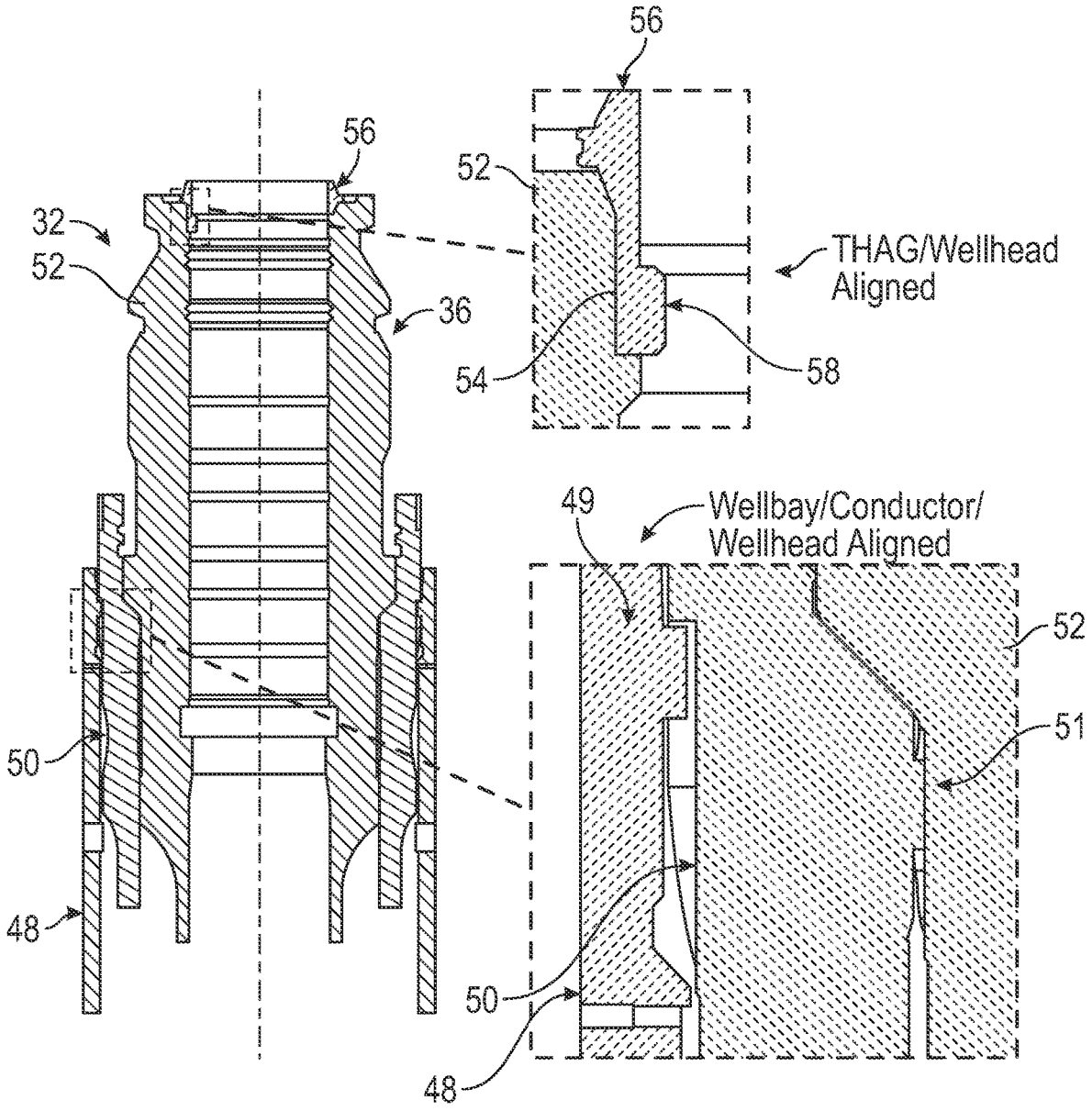
FIG. 3 shows a cross-sectional side view of a self-aligned wellhead system (SAWS) for ITS well installation, according to an embodiment.

FIG. 3 shows a cross-sectional side view of a SAWS 32 for ITS well installation, according to an embodiment. The alignment feature 54, e.g. key way/slot, inside the wellhead housing 52 may be used to land a temporary sleeve (i.e., lockdown sleeve, casing hanger, etc.) that may then have the final alignment pin/key for the tubing hanger to be oriented accordingly.

Similarly, if the SAWS 32 is used for a satellite well installation, at least two options may be employed. In option 1, the same alignment pin/features used on the ITS well installation (mentioned above) can be used, with the exception that the CH does not interface with another structure, but instead is substantially aligned when it is installed using a remotely operated vehicle (ROV) or a gyroscope based tool. In option 2, a wellhead system is used without special alignment pins/features and without key way 54 inside the WH 52. Instead, the tubing hanger alignment gasket (THAG) 56 may be installed with ROV assistance and then the ROV orientates the THAG 56 in the direction the TH 40 and VXT 38 is intended to face.

Figure 4:
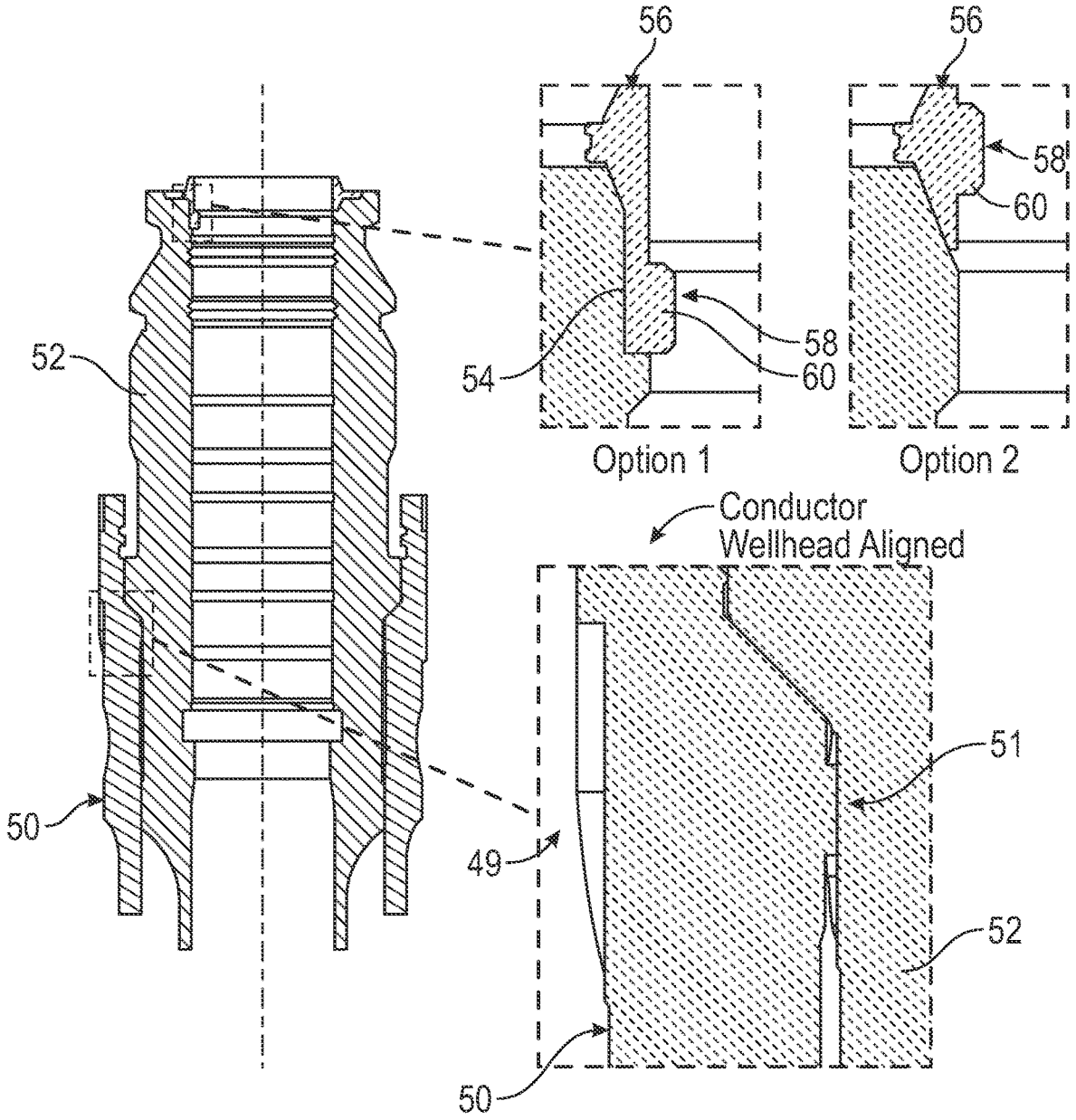
FIG. 4 shows a cross-sectional side view of a SAWS for satellite well installation, according to an embodiment.

FIG. 4 shows a cross-sectional side view of a SAWS 32 for satellite well installation, according to an embodiment. The SAWS disclosed herein may reduce the installation costs for customers. It provides a simple mechanical alignment, reduces tolerances in the installation which provides more flexibility to the system, eliminates the use of specialty running tools, and reduces the chances to have a misaligned TH 40 installed. The SAWS 32 can be used for TH systems 40 that are mono-bore, dual bore, and any other types that can be designed in the future.

The tubing hanger alignment gasket (THAG) 56 provides a solution to the complex problem of tubing hanger (TH) 40 alignment for vertical christmas trees (VXT) 38 where the TH 40 is installed inside the wellhead housing 52, thus, defining the orientation of the VXT 38. In a satellite installation, one where the wellhead system 32 does not have restrictions by a template structure or space, the alignment of the TH 40 has greater flexibility as the VXT 38 (run without guidelines) may not be within a tight angular range. However, when the VXT 38 is to be installed in a template structure, the orientation of the VXT 38 may be dependent upon the location of the TH orientation key for the VXT 38 when landed in the wellhead housing 52. (Currently, several conventional methods are used to provide this alignment, but they use extensive amounts of equipment that are costly and increase set up time in the rig while not providing high levels of confidence due to the extensive tolerance studies required to make it work.)

Because the TH 40 is installed inside the wellhead housing 52, the THAG 56 redefines the gasket that is present between, for example, a wellhead housing hub and a blowout preventer (BOP) and VXT hubs to ensure the TH alignment is consistent. This may also allow TH orientation tools to be omitted, reduce BOP modifications, reduce complex tolerance loops, and reduce other equipment involved in the landing/installation of the TH inside the wellhead housing.

Figure 5:
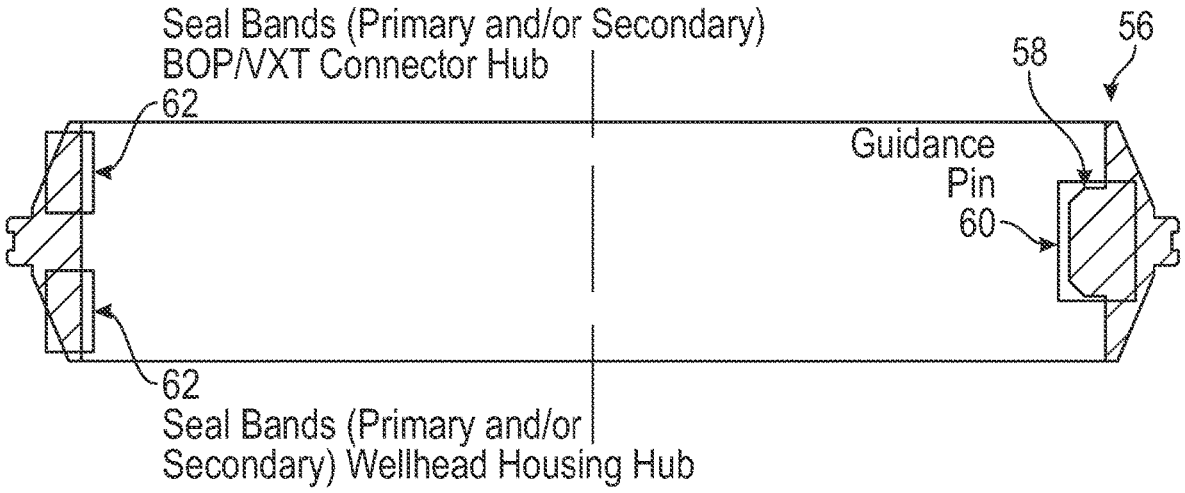
FIG. 5 shows a cross-sectional side view of a tubing hanger alignment gasket (THAG), according to an embodiment.
Figure 6:
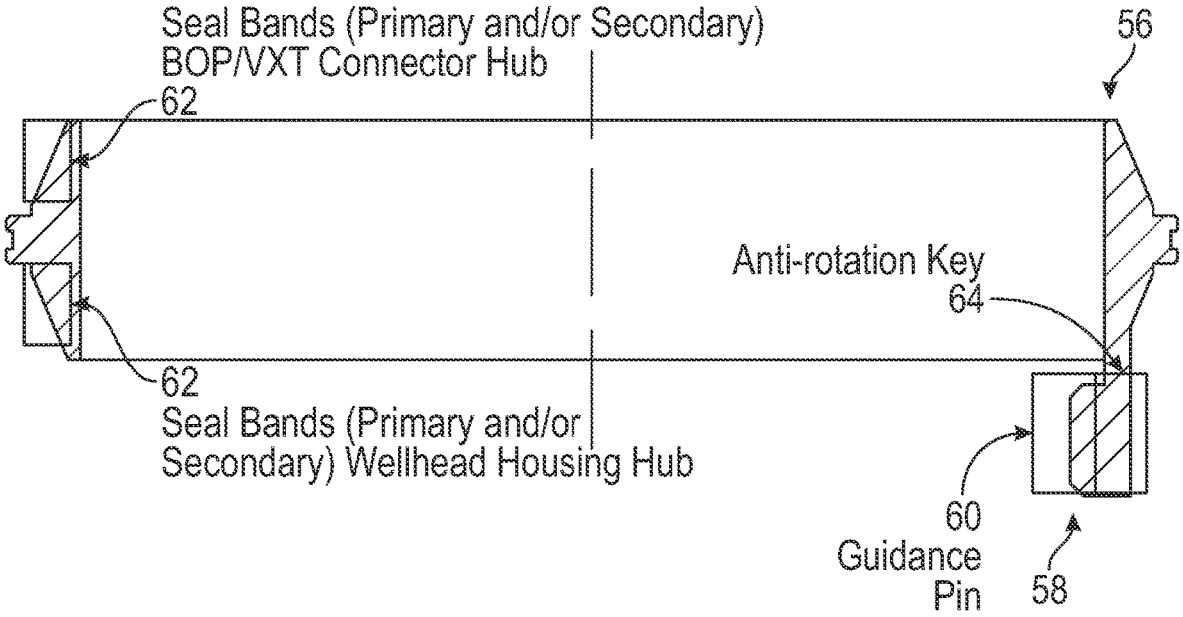
FIG. 6 shows a cross-sectional side view of another THAG, according to an embodiment.
Figure 7:
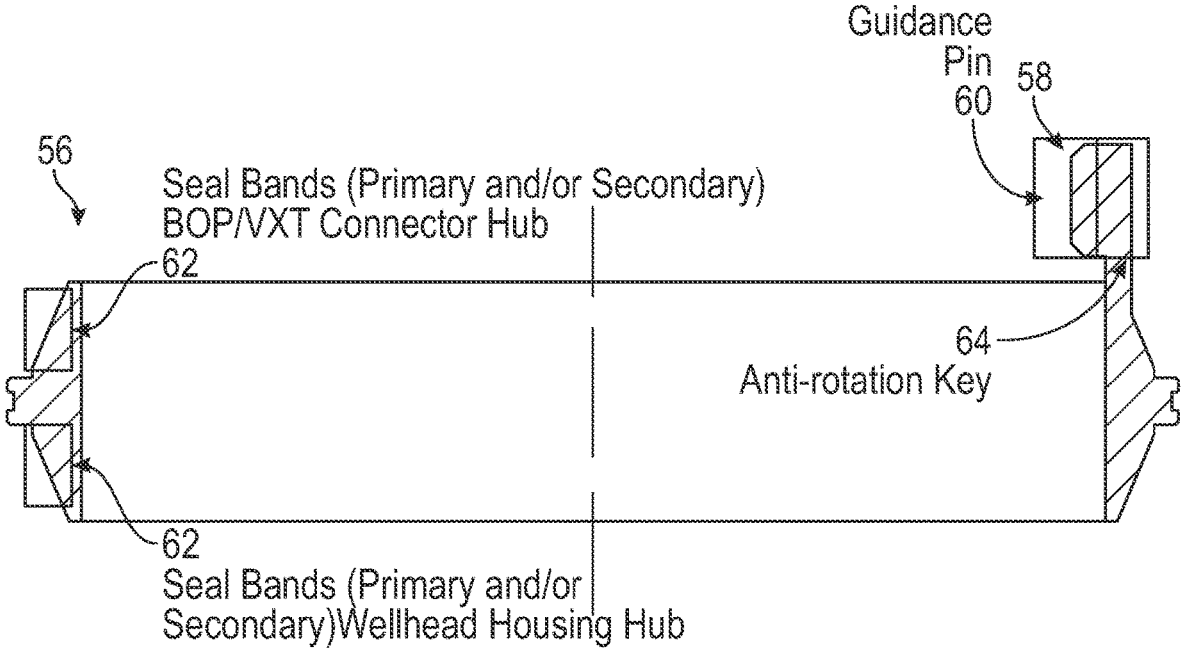
FIG. 7 shows a cross-sectional side view of yet another THAG, according to an embodiment.

FIGS. 5-7 show cross-sectional side views of different tubing hanger alignment gaskets 56, according to embodiments. The THAG 56 may have a modified gasket design that incorporates guidance feature 58 in the form of, for example, an alignment pin 60 within the internal diameter to serve as a guidance for orienting the TH 40 as shown in FIG. 5. The THAG 56 also may comprise seal bands 62 oriented to seal with, for example, wellhead housing hubs and/or various connector hubs. Additionally, the THAG 56 may comprise an anti-rotation feature 64, e.g. an anti-rotation key, sized for receipt in alignment feature/slot 54. In the embodiment illustrated in FIG. 6, the guidance feature 58 comprises alignment pin 60 located on the bottom side of the THAG 56. In the embodiment illustrated in FIG. 7, the guidance feature 58 comprises alignment pin 60 located on the top side of THAG 56. The alignment pin 60 may be formed as an integrated alignment feature.

The systems and methods disclosed herein may simplify the landing/installation of the VXT systems while providing the industry with a more accurate, simpler, and cost-effective way of doing so. Although some embodiments employ the self-aligned wellhead system 32 and certain modifications to the body of the TH 40, implementation of the THAG 56 may reduce the cost of running/installation VXT systems giving users a technical and commercial advantage over the competition.

The SAWS 32 takes a conventional wellhead system and transforms it into an alignment loop for the TH 40 and eventually the VXT 38. Because at least two configurations are possible (e.g., satellite and ITS well installations), the following describes the features on each component.

Figure 8:
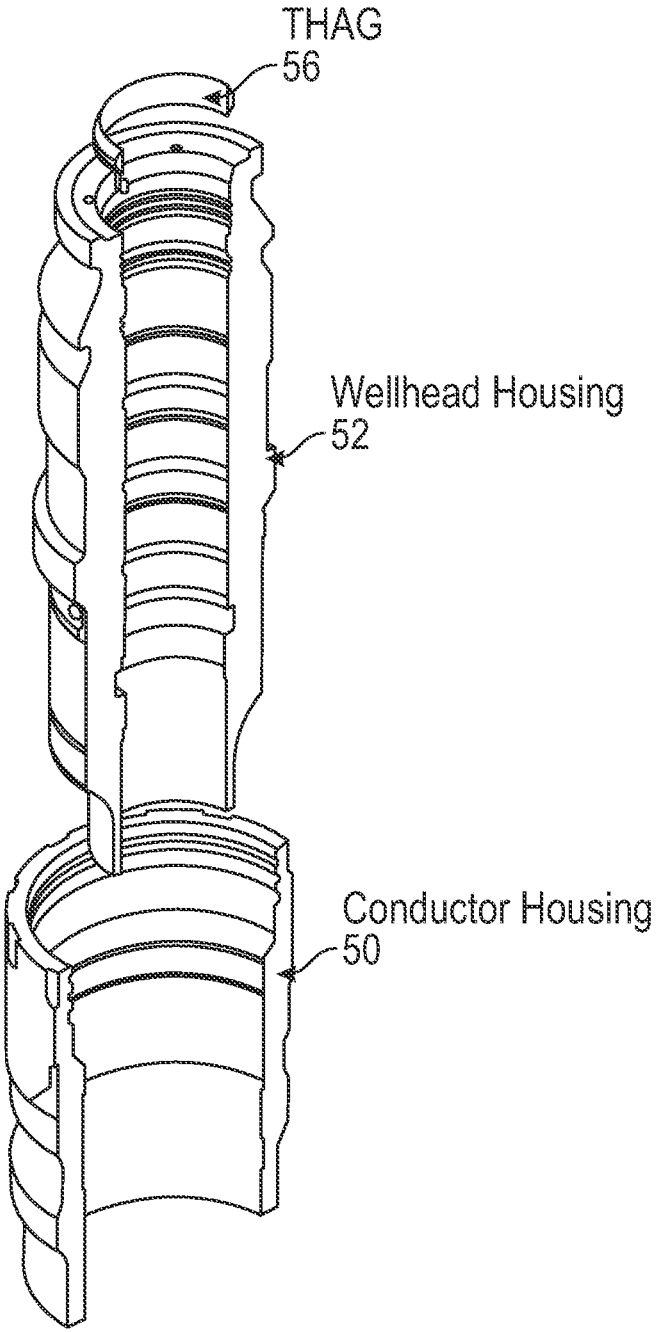
FIG. 8 shows a cross-sectional perspective view of SAWS assembly components for a satellite well, according to an embodiment.
Figure 9:
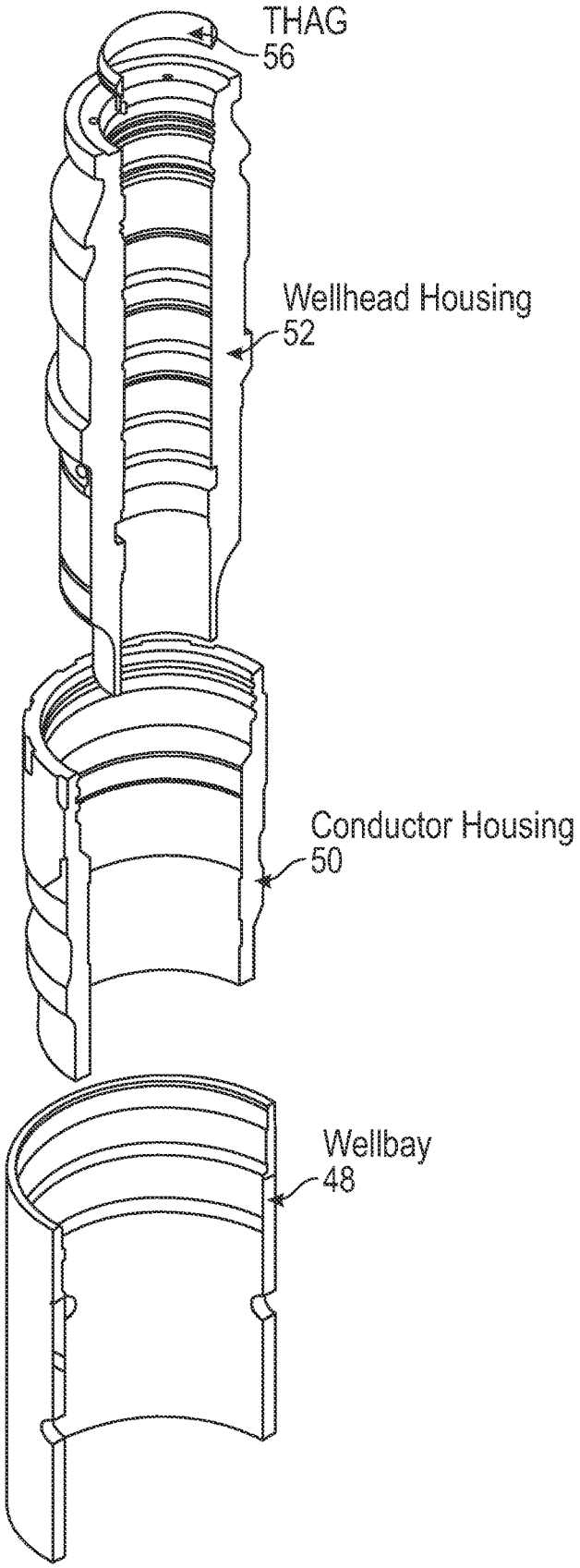
FIG. 9 shows a cross-sectional perspective view of SAWS assembly components for an ITS well, according to an embodiment.

FIG. 8 shows a cross-sectional perspective view of SAWS assembly components for a satellite well. Additionally, FIG. 9 shows a cross-sectional perspective view of SAWS assembly components for an ITS well, according to an embodiment.

Figure 10:
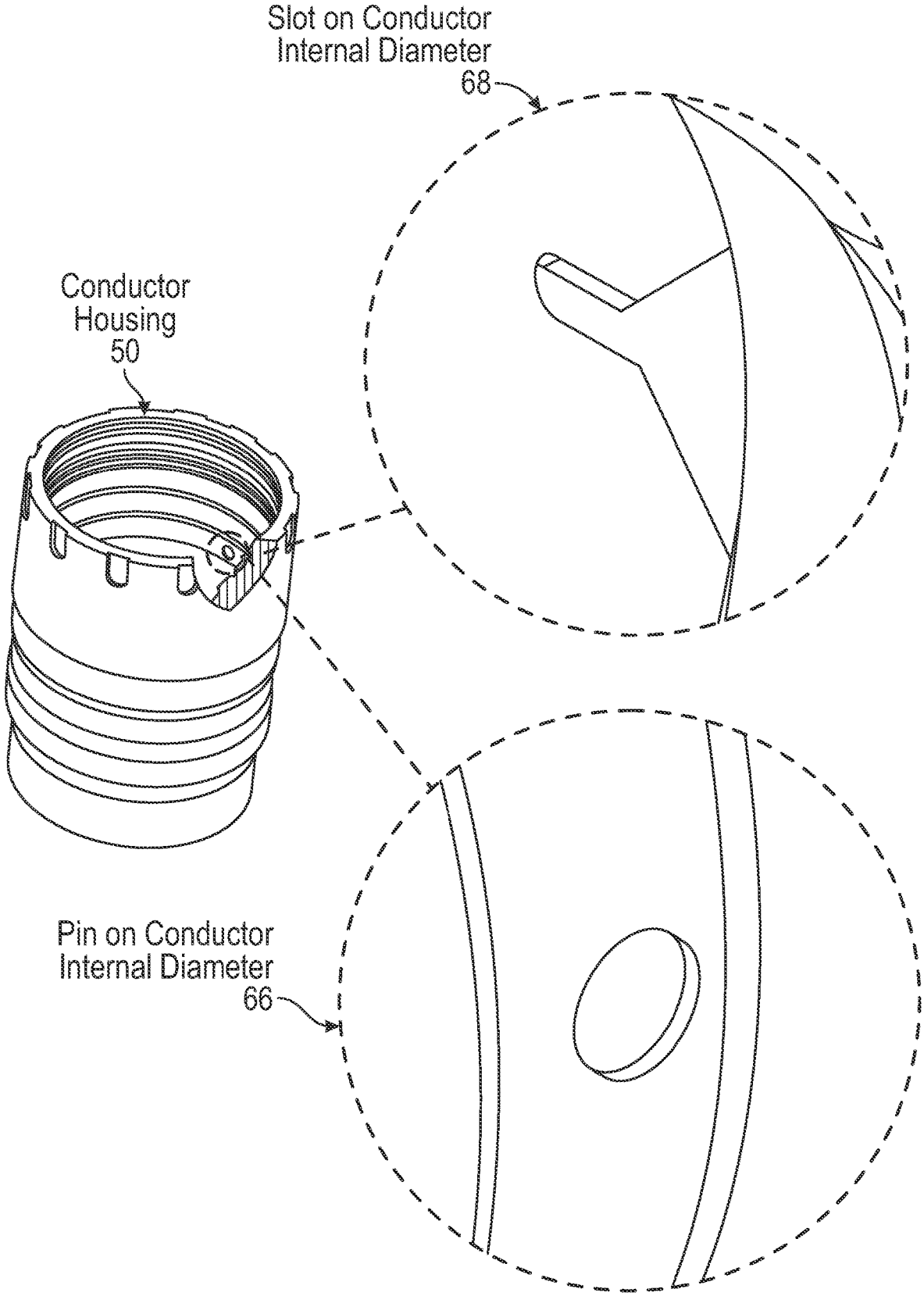
FIG. 10 shows a perspective view of a conductor housing pin/slot alignment on the inner diameter, according to an embodiment.

FIG. 10 shows a perspective view of a conductor housing alignment system 51 which may utilize a pin CH pin 66 or CH slot 68 located along the inner diameter of the CH 50, according to an embodiment. For the satellite well, the CH 50 may have an alignment pin 66 positioned along its internal diameter, as shown in FIG. 10, so that the pin 66 interfaces with a corresponding alignment slot in the external diameter of the WH 52. Similarly, the alignment pin can be in the WH external diameter while the alignment slot 68 is located along the internal diameter of the CH 50. If a guide pin is used, it can be pre-machined on the CH 50 or installed afterwards using threads, welding, or other techniques, as shown in FIG. 10.

Figure 11:
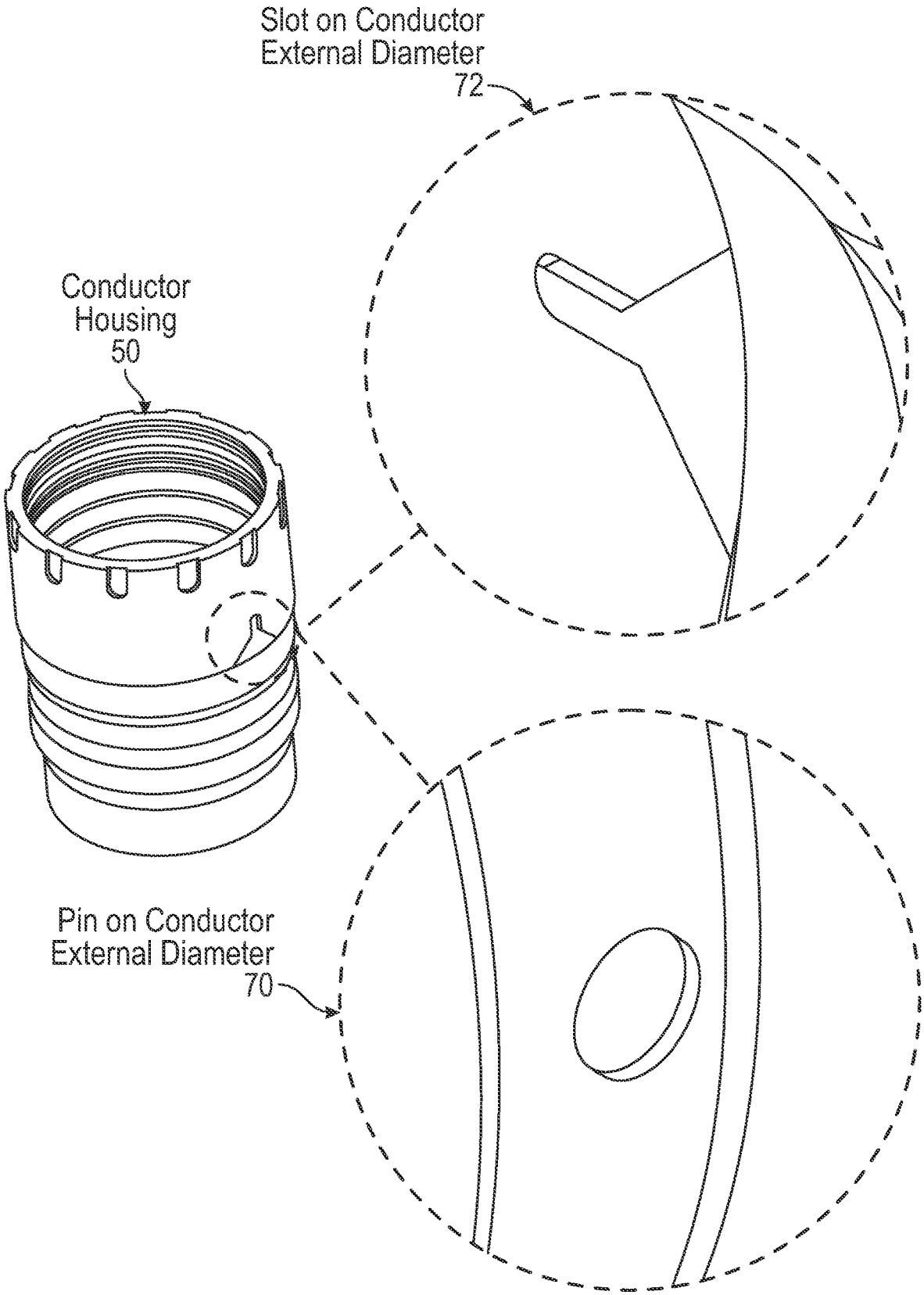
FIG. 11 shows a perspective view of a conductor housing pin/slot alignment on the outer diameter, according to an embodiment.

FIG. 11 shows a perspective view of a conductor housing pin/slot alignment on the outer diameter, according to an embodiment. If the CH 50 is used in an ITS well installation, an additional external alignment pin 70 or alignment slot 72 can be used on its external diameter, as shown in FIG. 11. This alignment pin 70 or slot 72 may then interface with its counterpart alignment pin/slot in the ITS wellbay 48. The pin 70 or slot 72 and the counterpart alignment pin/slot may be part of the alignment system 49.

Figure 12:
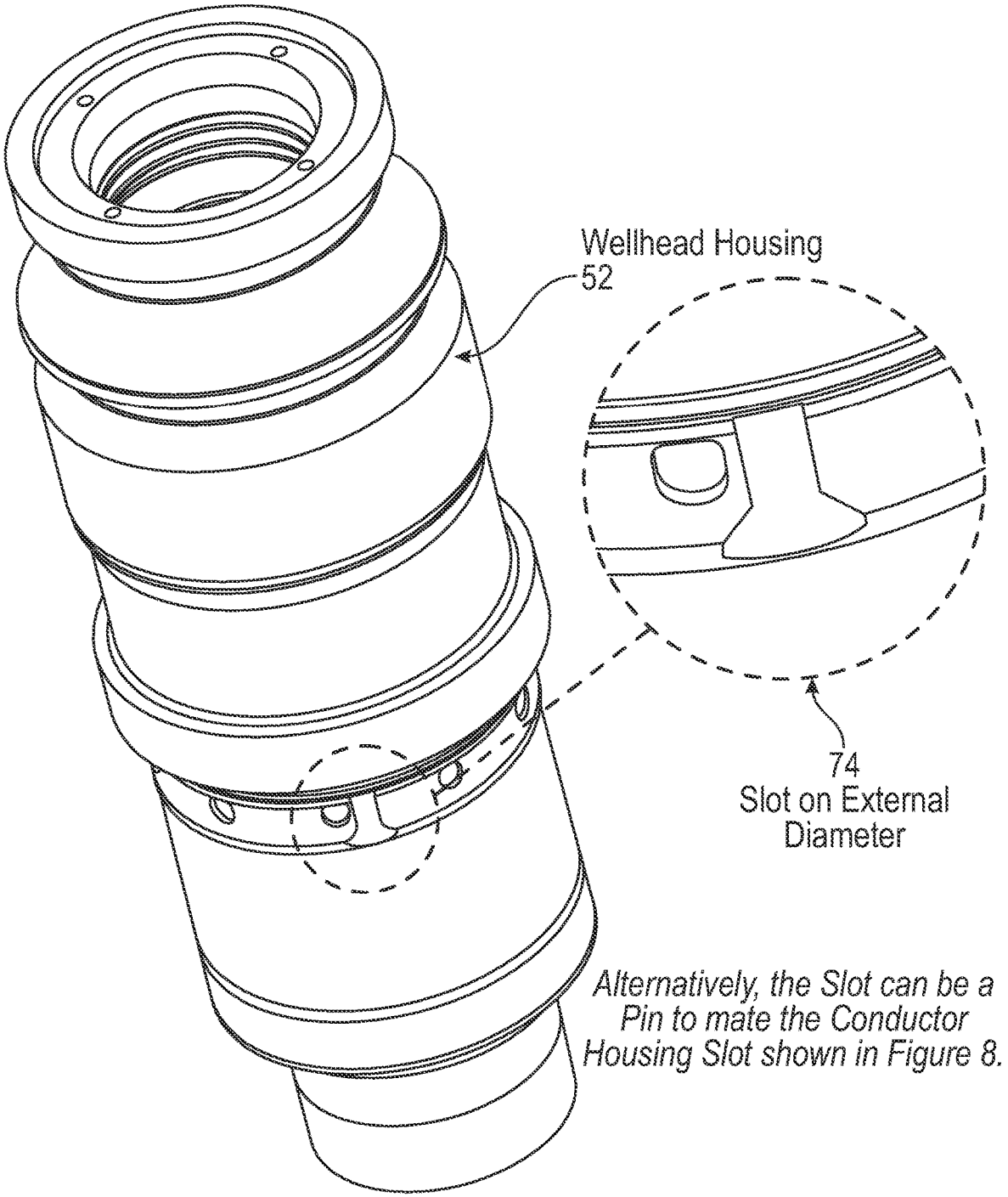
FIG. 12 shows a perspective view of a wellhead housing pin/slot alignment on the outer diameter, according to an embodiment.

FIG. 12 shows a perspective view of the wellhead housing 52 having alignment features 74 which may be part of alignment system 51. The alignment feature 74 may utilize a pin/slot alignment feature on the outer diameter, according to an embodiment. The WH 52 may have an alignment pin/slot on its external diameter to interface with its counterpart feature on the internal diameter of the CH 50 as shown in FIG. 7.

Figure 13:
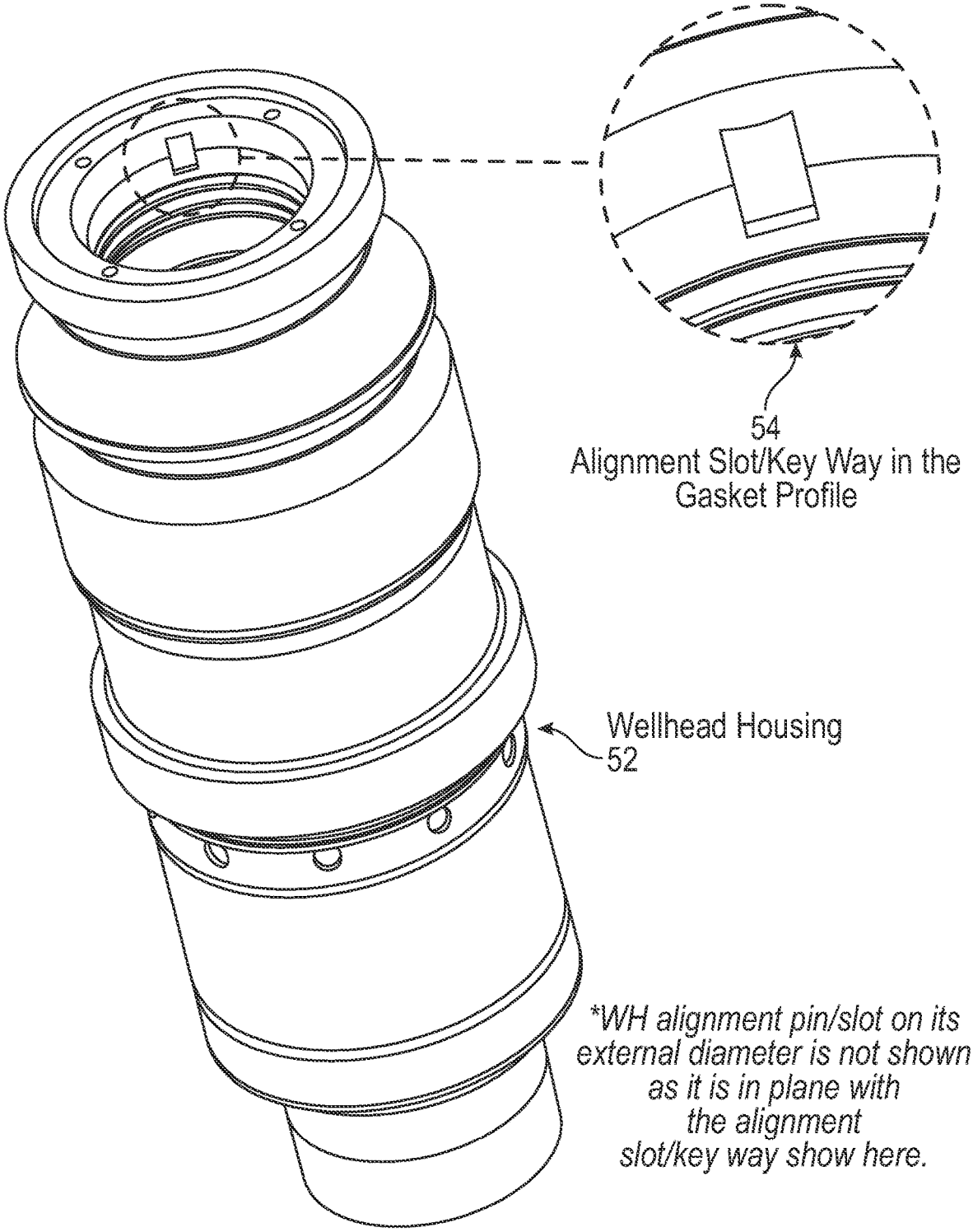
FIG. 13 shows a perspective view of a wellhead housing alignment slot for a THAG or sleeve, according to an embodiment.

FIG. 13 shows a perspective view of a wellhead housing alignment slot 54 positioned to receive the THAG 56 or sleeve, according to an embodiment. In another embodiment, the WH 52 may have a bolted-on pin on its internal diameter and use it, instead of the THAG 56, to align the TH 40. Additionally, the WH 52 may have an alignment slot/key way in the WH hub gasket profile or below the tubing hanger lockdown grooves, as shown in FIG. 13, or on its internal diameter below the gasket profile to ensure alignment with the TH 40. The alignment slot 54 may receive the THAG 56 or sleeve that may provide the final orientation of the TH 40 and eventually the VXT 38.

Figures 14A, 14B, 14C:
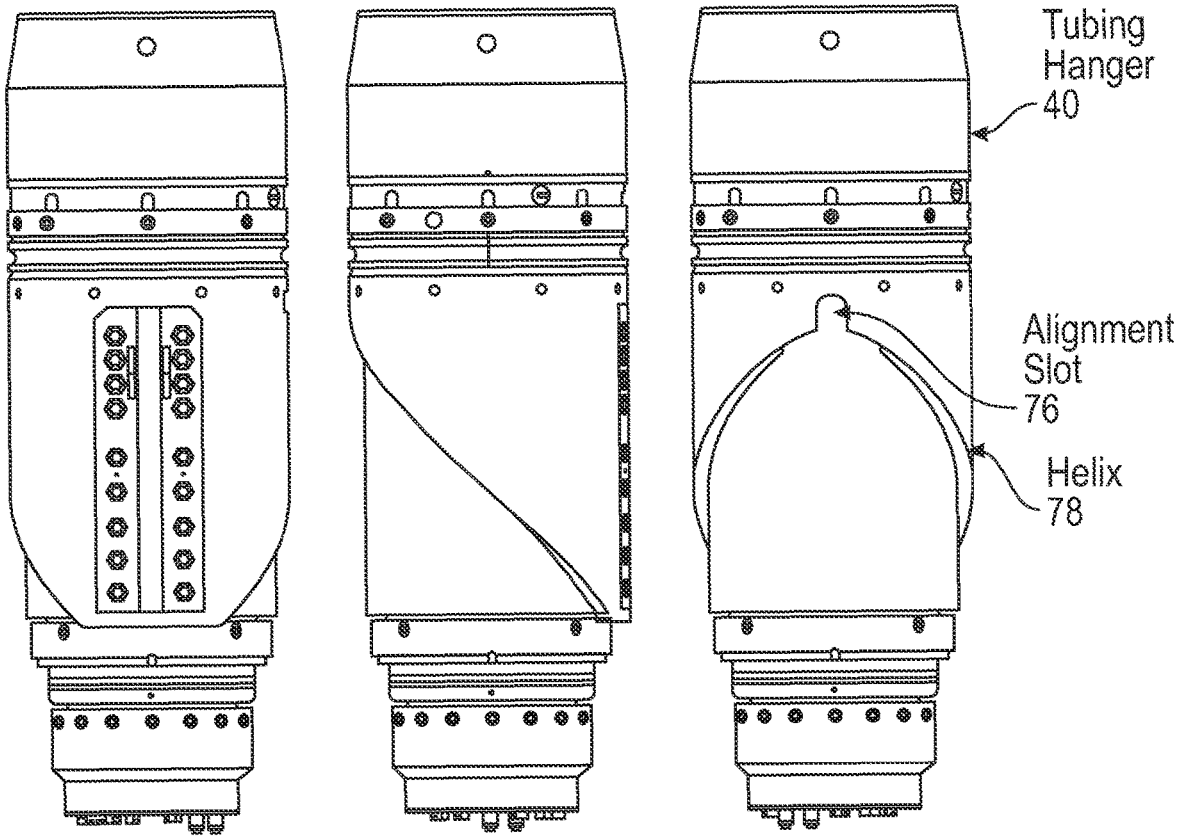
FIGS. 14A-C show side views of a tubing hanger alignment slot, according to an embodiment.

FIGS. 14A-C show side views of a tubing hanger alignment slot 76, according to an embodiment. The TH 40 may be modified to include slot 76 in its external diameter that interfaces with the alignment pin 60 in the THAG 56, previously oriented by the WH 52. The alignment slot 76 (which may be in the form of or may utilize an orientation helix 78) for installing the TH 40 may be located on the tubing hanger orientation joint (THOJ) and may form part of the subsea landing string.

Figure 15:
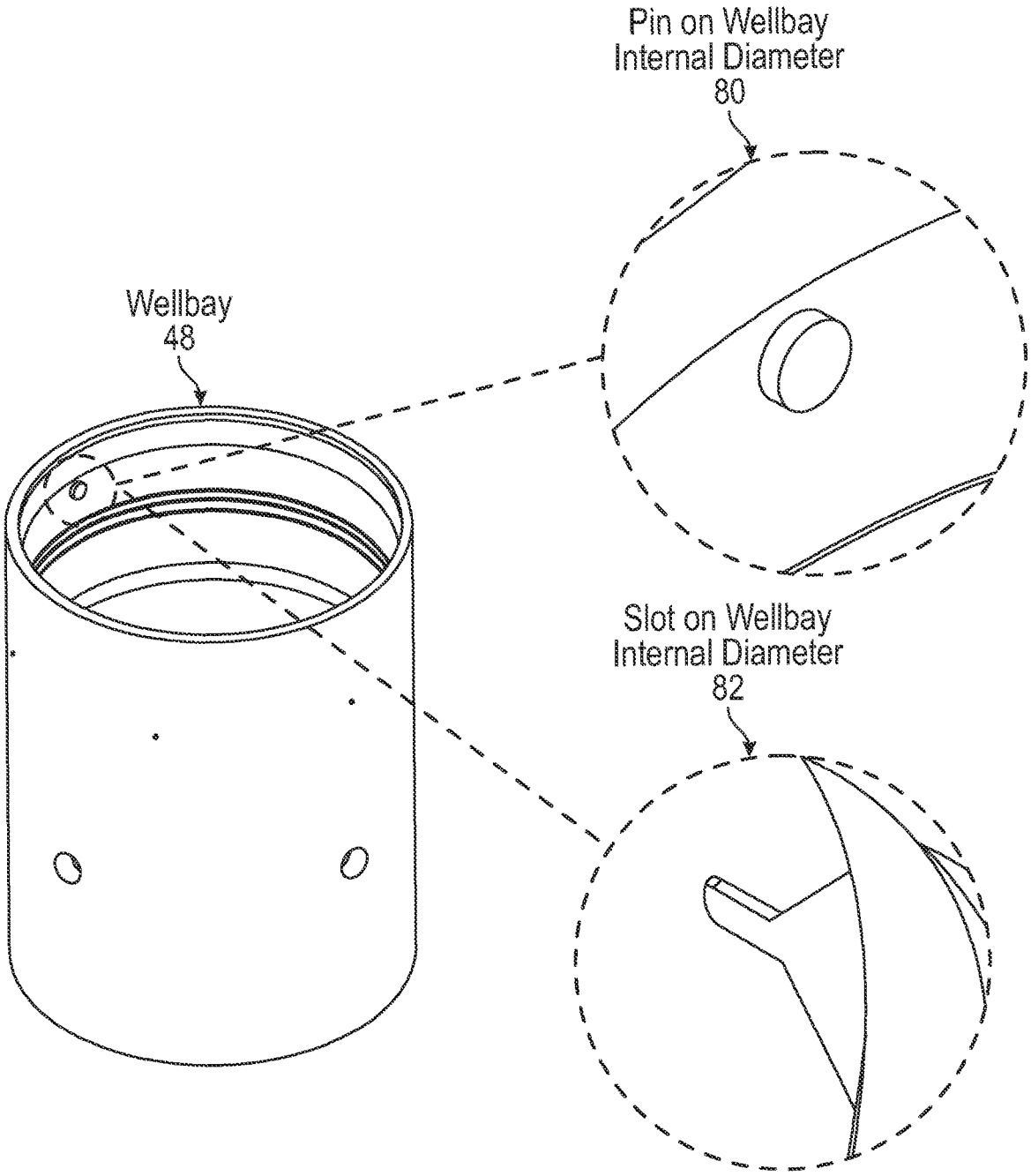
FIG. 15 shows a perspective view of a wellbay pin/slot alignment on an inner diameter, according to an embodiment.

FIG. 15 shows a perspective view of a portion of the alignment system 49 in which wellbay 48 comprises a pin 80 or slot 82 located along an inner diameter, according to an embodiment. For the ITS well installation, the wellbay 48 may have an alignment pin/slot in its internal diameter to interface with its counterpart feature on the CH external diameter shown in FIG. 11.

Figure 16:
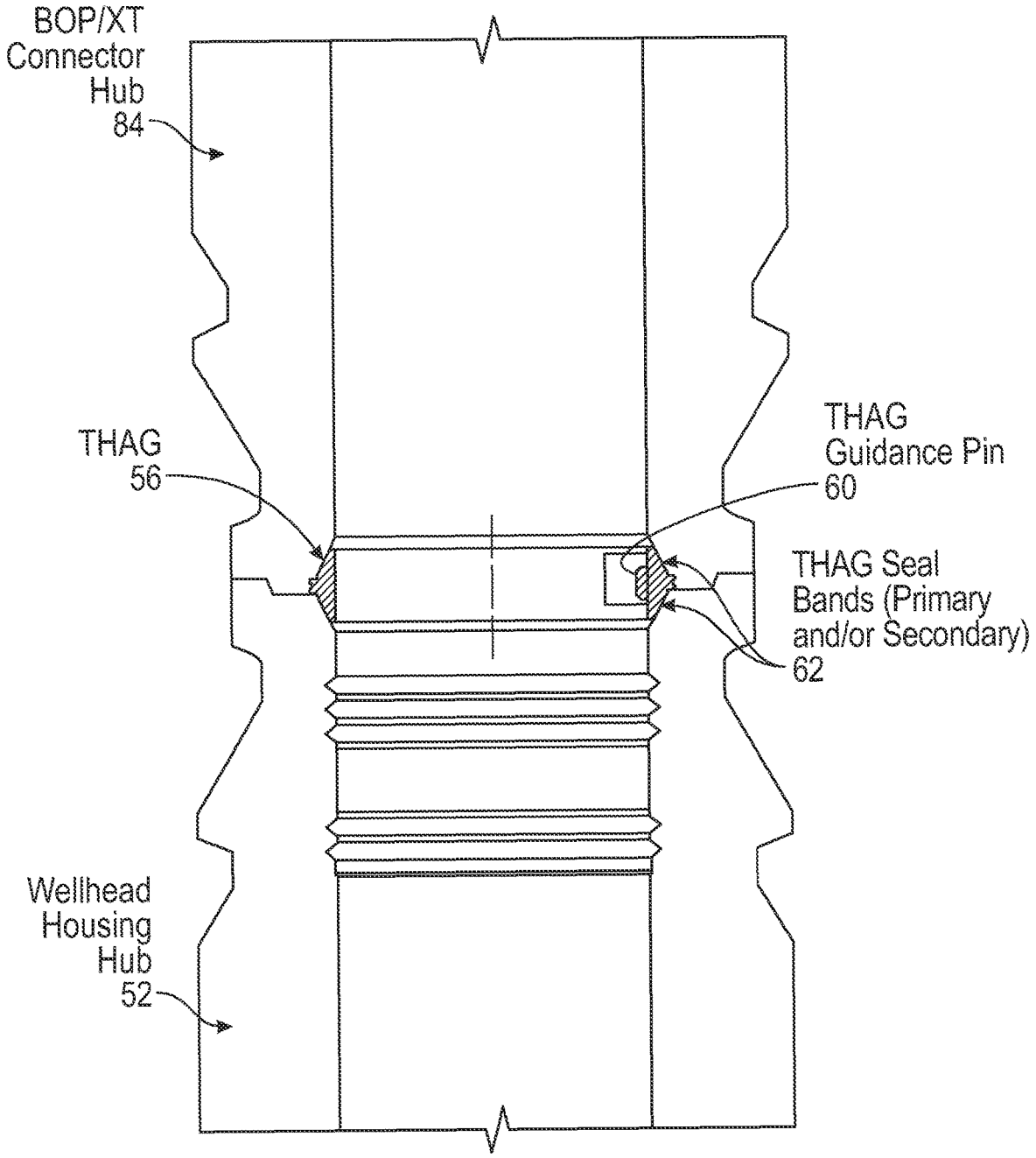
FIG. 16 shows a cross-sectional side view of a THAG layout oriented by a running tool before hubs are preloaded, according to an embodiment.
Figure 17:
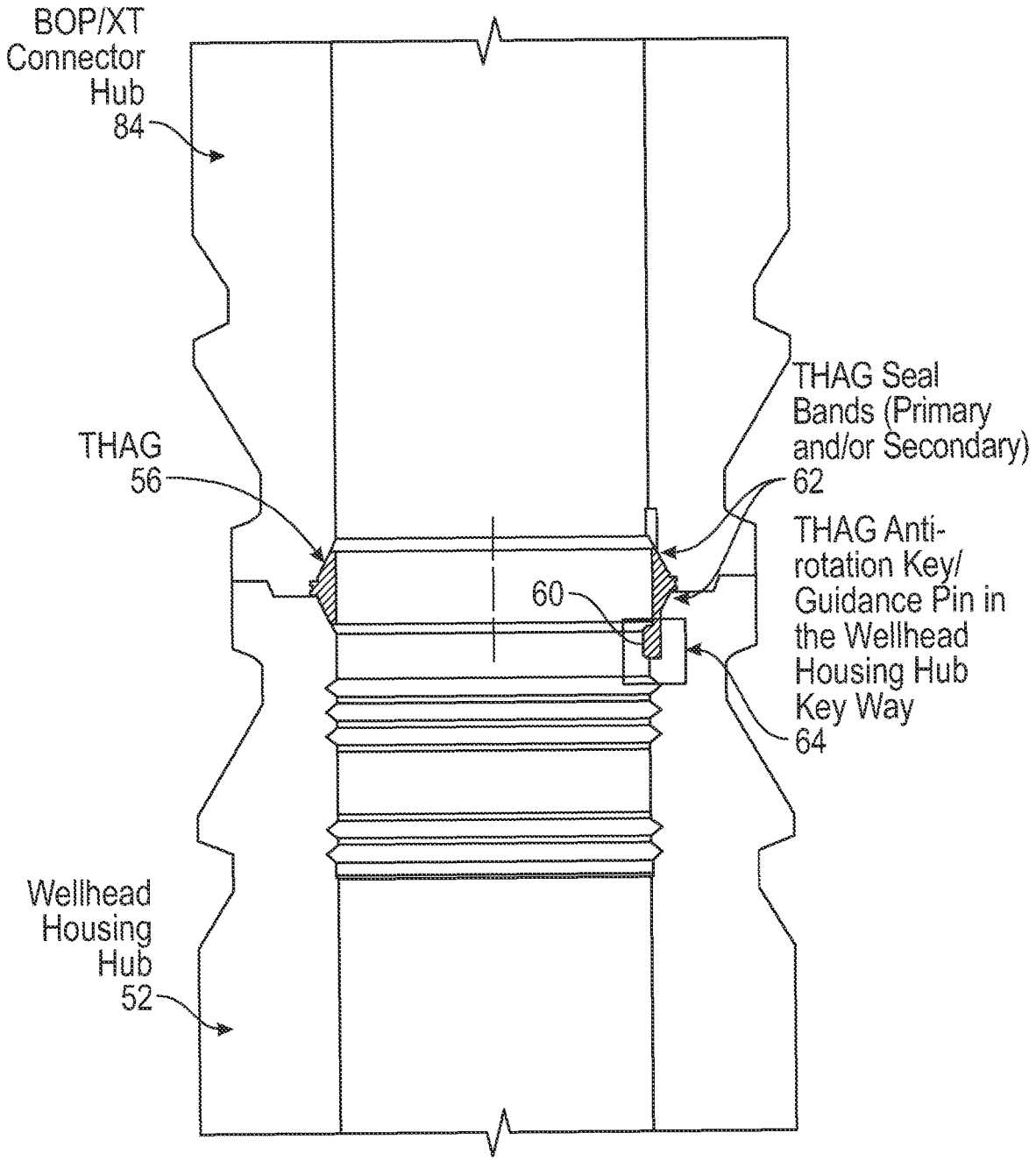
FIG. 17 shows a cross-sectional side view of a THAG oriented at the wellhead housing hub, according to an embodiment.

FIG. 16 shows a cross-sectional side view of a THAG 56 located between WH 52 and a BOP/XT connector hub 84. The THAG layout may be oriented by a running tool before hubs are preloaded. FIG. 17 shows a cross-sectional side view of the THAG 56 oriented at the wellhead housing 52, e.g. wellhead housing hub, according to an embodiment. The modifications above can be used as part of a single assembly as shown in FIGS. 16 and 17 or individually as needed to ensure TH alignment. The SAWS 32 may use existing systems with some modifications to simplify the installation and alignment of the TH 40 and VXT 38.

The THAG 56 may be in the form of a gasket design with guidance that allows for a component that is installed in another tubular passing through a connection of two hubs (i.e., a TH 40 installed in a wellhead housing 52 after passing through a BOP/VXT connector hub 84) to be oriented in any direction. The THAG 56 may eliminate the complex tools otherwise used to run the TH 40 (conventional systems also use modifications to the BOP and other pieces of equipment in the rig floor). Guidance is created by the gasket itself and not by a set of modified pieces of equipment that are costly. Because existing gaskets are compressed between two hubs, anti-rotation of the THAG 56 may be used to ensure proper orientation of the TH 40.

According to a first option, the THAG body has the guidance pin 60 built in within its internal diameter, as shown in FIG. 5, and torsional capacity is left purely to the friction created by the connection preload (e.g., a connector with preload is used between the wellhead housing and the BOP/VXT) between the two hubs and the amount of surface subjected to this preload. The orientation for the THAG itself is provided by a THAG running tool that may be ROV-operated. The seal bands 62 for the THAG 56 provide pressure containment for a primary, secondary, or both seal surfaces between the wellhead housing and BOP/VXT connector hubs. This configuration may be used in satellite well systems where orientation allowances are more flexible, and a SAWS may be omitted. FIG. 4 shows a reference layout of the THAG.

According to a second option, shown in FIG. 6, the THAG's guidance pin 60 may be machined in the anti-rotation key located in the lower part of the THAG facing its internal diameter. This option ensures that orientation for the TH is provided relative to a wellhead housing orientation commonly defined by an ITS. The seal bands 62 for the THAG 56 provide pressure containment for a primary, secondary, or both seal surfaces between the wellhead housing and BOP/VXT connector hubs. In this option, the THAG may enter a key way inside the wellhead housing and torsional capacity may be provided by both, the friction created by the connection preload as described in the first option and by the torsional capacity between the THAG's anti-rotation key and the wellhead housing the key way. FIG. 5 shows a reference layout of the THAG.

Figure 18:
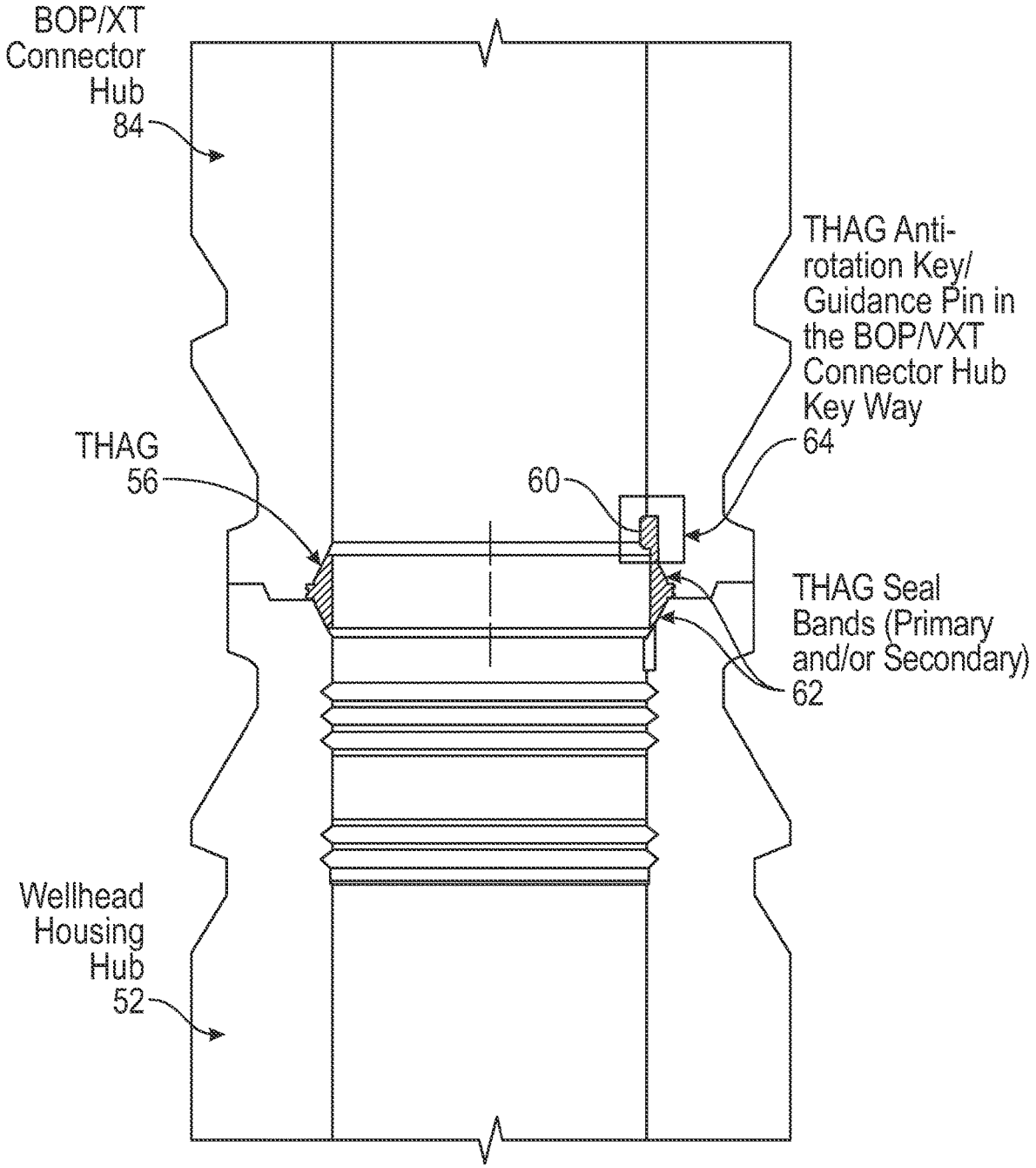
FIG. 18 shows a cross-sectional side view of a THAG oriented at the BOP/VXT connector hub, according to an embodiment.

According to a third option, shown in FIG. 7, the THAG's guidance pin 60 is machined in the anti-rotation key located in the upper part of the THAG facing its internal diameter. This option ensures that orientation for the TH is provided relative to a relative to a BOP/VXT connector hub orientation. The seal bands 62 for the THAG 56 provide pressure containment for a primary, secondary, or both seal surfaces between the wellhead housing and BOP/VXT connector hubs. In this option, the THAG may enter a key way inside the BOP/VXT connector hub, and torsional capacity may be provided by both the friction created by the connection preload as described in the first option and by the torsional capacity between the THAG's anti-rotation key and the BOP/VXT connector hub key way. FIG. 18 shows reference layout of the THAG. More particularly, FIG. 18 shows a cross-sectional side view of a THAG 56 oriented at the BOP/VXT connector HUB, according to an embodiment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A method to angularly orientate a conductor housing, a wellhead and a tubing hanger with respect to each other, comprising:

landing the conductor housing inside a wellbay;

engaging a first alignment feature on an internal diameter of the wellbay with an orientation feature on an external diameter of the conductor housing;

engaging an alignment pin on the conductor housing within a wellhead housing, wherein the alignment pin and the wellhead housing set orientation of the conductor housing within the wellhead, wherein the wellhead housing comprises a second alignment feature;

landing a tubing hanger alignment gasket using the second alignment feature of the wellhead housing, wherein the tubing hanger alignment gasket provides orientation for the tubing hanger as the tubing hanger is landed through a blow-out preventer.

2. The method of claim 1, wherein the alignment pin is on an internal diameter of the conductor housing, and the alignment pin engages an external diameter of the wellhead housing.

3. The method of claim 1, wherein the second alignment feature of the wellhead housing is located on an internal diameter of the wellhead housing at a hub face gasket profile or below a tubing hanger lockdown groove.

4. The method of claim 1, wherein a weight of the conductor housing and the wellhead housing facilitates a twist to ensure engagement with the first alignment feature, the second alignment feature, or both.

5. The method of claim 1, further comprising providing the tubing hanger alignment gasket with a guidance pin extending radially inwardly.

6. The method of claim 1, further comprising providing the tubing hanger alignment gasket with a guidance pin located on the top side of the tubing hanger alignment gasket.

7. The method of claim 1, further comprising providing the tubing hanger alignment gasket with a guidance pin located on the bottom side of the tubing hanger alignment gasket.

8. The method of claim 1, further comprising providing the tubing hanger alignment gasket with an anti-rotation key.

9. The method of claim 1, wherein the first alignment feature, the alignment pin and the second alignment feature are in the same vertical plane.

10. A system to angularly orientate a conductor housing, a wellhead and a tubing hanger with respect to each other, comprising:

a wellbay comprising an internal diameter with a first alignment feature;

a conductor housing concentrically located within the wellbay and comprising an orientation feature on an external diameter of the conductor housing and an alignment pin, wherein the first alignment feature is configured to engage the orientation feature;

a wellhead housing in the wellhead, such wellhead housing being configured to receive the alignment pin to set orientation of the conductor housing within the wellhead, wherein the wellhead housing comprises a second alignment feature;

a tubing hanger alignment gasket configured to be landed using the second alignment feature of the wellhead housing, wherein the tubing hanger alignment gasket provides orientation for the tubing hanger as the tubing hanger is landed through a blow-out preventer.

11. The system of claim 10, wherein the alignment pin is on an internal diameter of the conductor housing, and the alignment pin engages an external diameter of the wellhead housing.

12. The system of claim 10, wherein the second alignment feature of the wellhead housing is located on an internal diameter of the wellhead housing at a hub face gasket profile or below a tubing hanger lockdown groove.

13. The system of claim 10, wherein a weight of the conductor housing and the wellhead housing facilitates a twist to ensure engagement with the first alignment feature, the second alignment feature, or both.

14. A system to angularly orientate a wellhead and a tubing hanger with respect to each other, comprising:

a wellhead housing having an internal diameter with a self-guided alignment feature; and a tubing hanger alignment ring gasket landed concentrically inside the wellhead housing using the alignment feature of the wellhead housing, wherein the tubing hanger alignment ring gasket comprises a guidance feature;

wherein the tubing hanger is configured to land inside the wellhead housing at a desired orientation via engagement with the guidance feature during landing.

15. The system of claim 14, further comprising a conductor housing which receives the wellhead housing, the wellhead housing being oriented via a wellhead housing alignment system.

16. The system of claim 15, further comprising a wellbay which receives the conductor housing, the conductor housing being oriented via a conductor housing alignment system.

17. The system of claim 16, wherein an alignment pin is located on an internal diameter of the conductor housing, the alignment pin being oriented to engage an external diameter of the wellhead housing.

18. The system of claim 17, wherein the alignment feature of the wellhead housing is located on the internal diameter of the wellhead housing.

19. The system of claim 14, wherein the guidance feature of the tubing hanger alignment ring gasket comprises a pin oriented in a radially inward direction.

* * * * *